US005086377A

United States Patent [19]

Roberts

[11] Patent Number: 5,086,377

[45] Date of Patent: Feb. 4, 1992

[54] PERSONAL ACCESSORY AND DEFENSE BATON

[76] Inventor: Bert Roberts, 7053 N. Oracle Rd., Tucson, Ariz. 85704

[21] Appl. No.: 708,237

[22] Filed: May 31, 1991

[51] Int. Cl.[5] ..... A63B 15/02

[52] U.S. Cl. ..... 362/102; 362/96; 362/234; 362/253; 42/1.08; 273/84 R; 222/113

[58] Field of Search ..... 362/190, 102, 109, 96, 362/101, 234, 253; 42/1.08; 273/84 R, 84 ES; 222/78, 113

[56] References Cited

U.S. PATENT DOCUMENTS 3,638,836 2/1972 Vickers, III ..... 362/96 X 3,756,467 9/1973 Anketell ..... 273/84 R 4,792,883 12/1988 Ackerman et al. ..... 362/102

4,842,277 6/1989 La Croix ..... 362/102 X

*Primary Examiner*—Stephen F. Husar

*Attorney, Agent, or Firm*—Gregory J. Nelson

[57] ABSTRACT

A non-lethal self defense weapon having an elongate baton-like housing with a centrally positioned grip. The opposite housing sections contain audible and visible alarm devices and a flashlight. A replaceable aerosol defense spray container is positioned in the housing with an actuator and nozzle positioned relative to the grip so as to aim the discharge away from the user and toward an assailant when properly grasped.

17 Claims, 3 Drawing Sheets

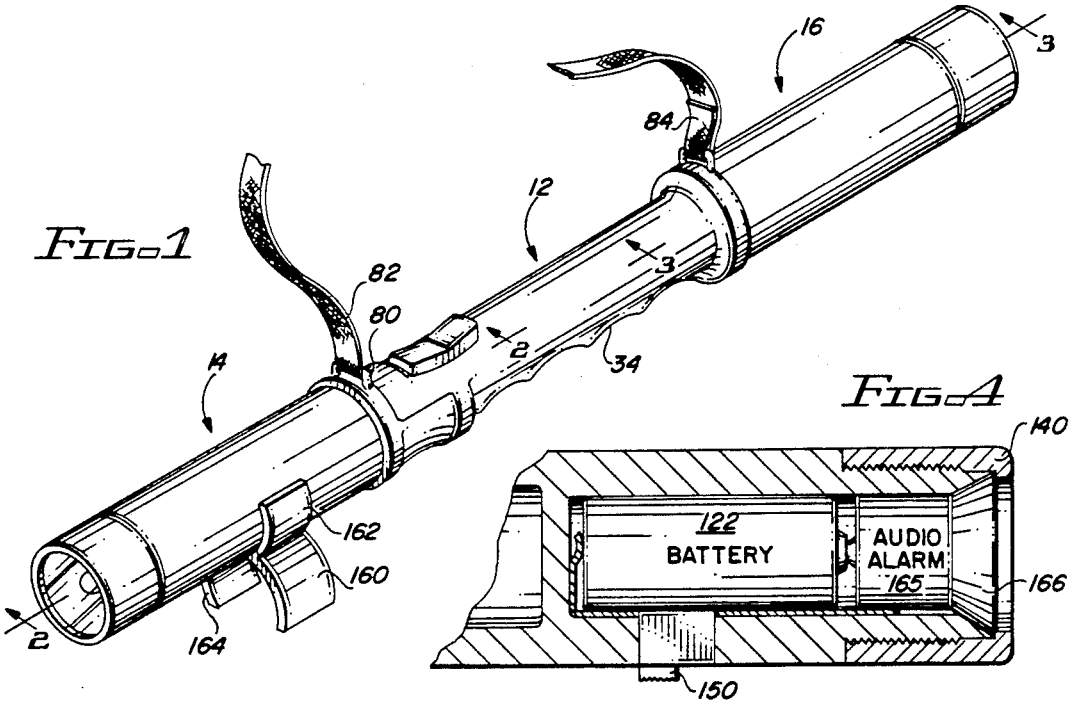
FIG. 1
FIG. 4
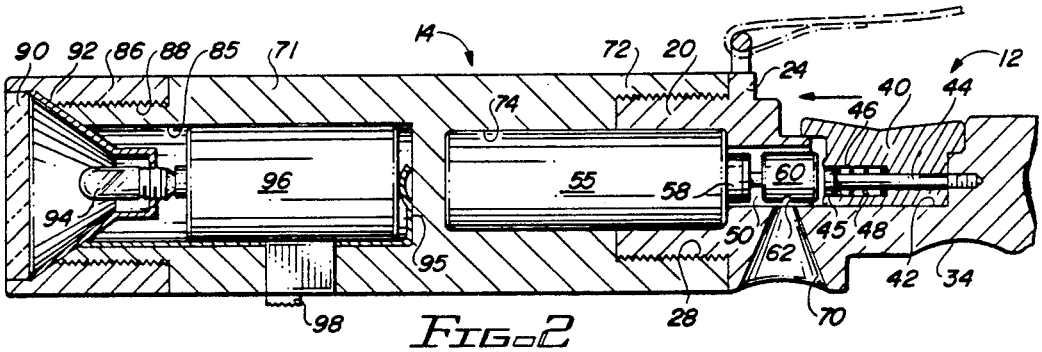
FIG. 2
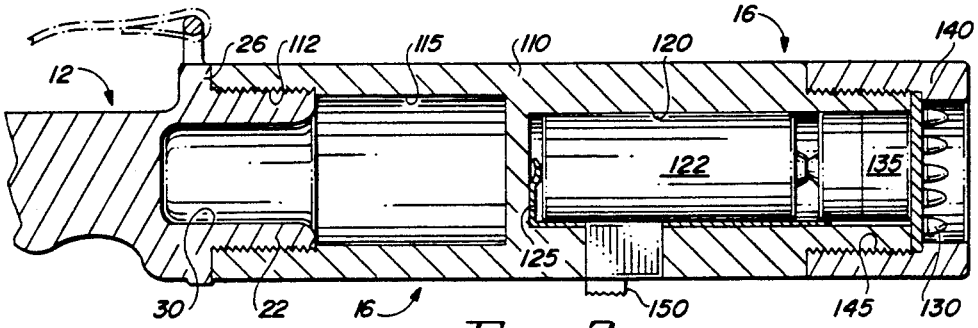
FIG. 3

PERSONAL ACCESSORY AND DEFENSE BATON

BACKGROUND OF THE INVENTION

The present invention relates to a protective accessory device and more particularly a type of device adapted to be carried by persons for self protection in the event of threat of bodily harm which device also includes audible and visual alarms as well as personal convenience accessories such as a flashlight.

It is a well known statistic that crimes against persons having increased in recent years. Accordingly, many people engaged in recreational and business activities frequently carry or maintain close at hand various protective devices of the type which will emit an immobilizing propellent or spray such as CS, CN or OC gas. It is also known to combine nonlethal immobilizing propellent devices in other devices such as a flashlight to provide the added convenience of a light and also to provide a deceptive appearance.

The following patents show representative multi-purpose devices of the general type having a defense or convenience feature:

U.S. Pat. No. 4,842,277 discloses a multipurpose baton for law enforcement personnel which combines a night stick, blinding light and electric probe.

U.S. Pat. No. 4,968,034 discloses a self protection device incorporating a flashlight, buzzer, flasher and electric shock device.

U.S. Pat. No. 4,792,883 discloses a runner's baton that can be held in the hand or worn on a belt. The baton includes a segmented cylinder having interchangeable compartments for holding various items needed by the runner.

U.S. Pat. No. 4,486,807 discloses a non-lethal self defense weapon having a housing, a power source, a pair of spaced probes for emitting an electrical shock and a source of light. Circuitry is provided for synchronizing the light pulses and the associated voltage potential at the probe so that the light pulses temporarily blind the assailant while the probes provide increased voltage pulses.

U.S. Pat. No. 2,908,901 discloses a combined night stick, flashlight and audible alarm.

U.S. Pat. No. 3,776,429 shows a combination flashlight and propellent discharge device which can discharge Mace, teargas, or other commercially available propellants.

U.S. Pat. Nos. 3,716,170; 3,638,836; and 2,629,516 are representative of prior art devices having a combination chemical ejector and light.

While the foregoing patents are representative of devices which provide protective devices in combination with other features, such devices have not been generally accepted for a variety of reasons and have certain disadvantages. Common disadvantages are that these devices are often awkward, bulky and inconvenient. Further, the prior devices are not designed for effective use as a defensive device while simultaneously emitting a nonlethal defense or deterrent spray.

Therefore, these exists a need for a combination personal accessory device and protective device that is convenient, attractive, properly balanced and provides the necessary personal and emergency features in a propellent discharge device.

It is therefore a primary object of the present invention to provide a new and improved nonlethal defense device.

It is a further object of the present invention to provide a defense device which may be conveniently carried by the user while engaged in recreational activities such as jogging, walking or running.

Still a further object of the invention is to provide a self defense device which has provision for containment of personal articles and which can emit an audible and/or visual alarm signal in the event of an emergency.

It is still a further object of the present invention to provide a self defense device having a convenient baton-like configuration which will emit or dispense deterrent chemicals when the device is held in an upright, self defense position.

Briefly the present invention relates to a non-lethal self defense device having a central grip with opposite housing members and when assembled has a baton-like configuration. The opposite housing members may be variously configured to contain ordinary flashlight or audible and visual emergency signal devices. A replaceable, non-lethal spray canister is contained in the device with nozzle and actuator positioned to aim the spray away from the user and toward an assailant when the grip is properly grasped.

BRIEF DESCRIPTION OF THE DRAWINGS

The above and other objects and advantages of the present invention will become more readily apparent from the following specification, claims and drawings in which:

FIG. 1 is a perspective view of the self protection device of the present invention;

FIG. 2 is a sectional view taken along lines 2—2 of FIG. 1;

FIG. 3 is a sectional view taken along lines 3—3 of FIG. 1;

FIG. 4 is a sectional view similar to FIG. 3 showing an alternate embodiment of the invention shown in FIG. 1;

Figure 5:
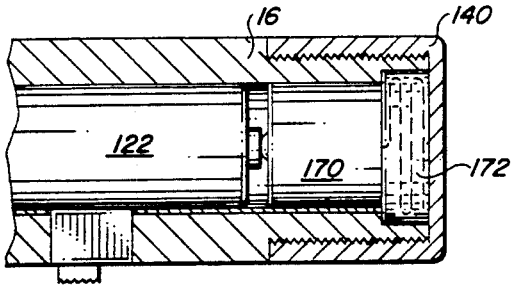
FIG. 5 is a sectional view similar to FIG. 4 showing still another embodiment of the present invention.

Turning now to the drawings in which like reference numerals designate the same or similar parts throughout the several views and with reference to FIGS. 1 to 3, an embodiment of the invention is shown and is generally designated by the numeral 10. Device 10 has a central grip section 12 with oppositely projecting generally cylindrical extension members 14 and 16. The device 10 may be constructed of various materials and preferably a durable, moldable impact-resistant plastic material such as ABS is suitable for this purpose.

The grip 12, as indicated, is located at an intermediate location for balance, weight distribution and also to contribute to the overall aesthetic baton appearance of the device. The grip 12 has a generally tubular body having threaded projections 20 and 22 at opposite ends of the handle or grip 12. Flange 24 extends annularly around the base of threaded projection 20. Similarly, annular flange 26 extends annularly about the base of threaded projection 22. A bore 28 is provided in projection 20 and in the assembled position defines one end of a compartment which, as will be explained, receives the body of an aerosol defense spray container. Similarly, projection 22 defines a bore 30 which in the assembled position defines one end of a compartment for containment of personal items.

Figure 6:
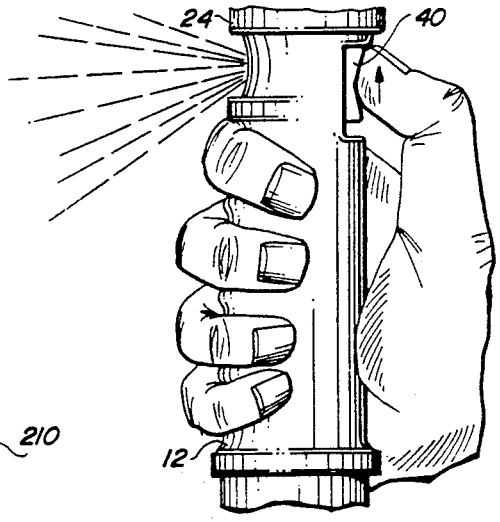
FIG. 6 is a pictorial view showing the device in a position of use in which a defense spray is discharged.

The grip 12 is shown as having a plurality of arcuately configured recesses 34 which are axially aligned along one side of the grip. As shown in FIG. 6, these are sized and positioned to accommodate the fingers of the user when the device is grasped. The recesses 34 also serve as a tactile guide to properly orient and position the device in the user's hand. When grasped with the fingers engaged in the finger recesses, the aerosol defense spray will be properly aimed away from the user and this proper orientation can be tactually accomplished quickly without the user having to inspect the device to properly position it. This is extremely important in the event of an attack where the user will be provided little time in which to grasp the device and place it in a position of use.

Further, once the device is properly grasped, the user's thumb, as shown in FIG. 6, will be immediately positioned on the aerosol actuator slide switch 40. The slide switch is located on the grip generally opposite the finger recesses at a position adjacent flange 24. As best seen in FIG. 2, the switch 40 is axially slidable in a slot 42. The slot 42 has an axial dimension somewhat longer than the axial length of the body of switch 40. Switch 40 is retained in position by a guide member having an elongate shank 44 which is in threaded engagement with an end wall of the slot 42. The opposite end of the guide has an enlarged head 45 which is received in a blind bore 46 axially extending in the slide switch. A compression spring 48 is interposed between the head 45 of the guide and the bottom of the end wall so it will be apparent that the slide can be moved axially towards flange 24 against the force exerted by the compression spring 46.

An axially extending passageway 50 extends between the recess 28 in projection 20 and slot 42. A suitable aerosol defense spray device 55 is replaceably positioned in the device with the upper end of the container seated in recess 28 of the grip. The valve 58 and cap 60 are receivable within the passageway 50. The cap which contains the discharge nozzle 62 is positioned with its end surface closely adjacent the surface 64 of the switch.

The grip 12 defines an outwardly opening nozzle 70 extending generally transversely through a portion of the grip and aligned with the orifice 62 in the aerosol spray cap. It will be apparent that by moving switch 40 leftwardly as shown in FIG. 2, the end of the switch will engage the cap 60 moving the cap leftwardly opening the valve 58 to release aerosol spray. The aerosol spray emanating from orifice 60 will be discharged through nozzle 70 in the device in a spray pattern.

For convenience, the grip may be provided with a pair of opposed loops 80 which receive a tether or strap 82. The opposite ends of the strap 82 are received through the loops 80 and may be provided with suitable fasteners such as loop and hook fastener material such as that sold under the trademark Velcro.

Section 14 is generally cylindrical and in the assembled position as shown in FIG. 1, extends forwardly from the intermediate grip section. Housing 14 has cylindrical housing 71 having internally threaded recess 72 which is detachably engageable with projection 20. A chamber 74 extends axially from the threaded recess 72 and in the assembled position aligns with recess 28 to form a compartment which is sized to accommodate the canister or body of the aerosol defense spray 55. The outer end of section 14 defines a compartment 85 which is closed by removable cap 86 which is in threaded engagement at 88 with the outer end of the housing member 71. The cap contains a lens 90 and a generally conical reflector 92 which receives a bulb 94. Recess 80 is sized to receive one or more standard or conventional flashlight batteries 96 such as "C" or "D" cells. A spring member 95 maintains the central battery terminal in engagement with the base of the bulb 94. The spring also serves as part of the conductive pathway from the negative base terminal of the battery and the threaded base of the bulb. A slide 98 is operable to turn the bulb on or off by completing and interrupting the electrical circuit in a manner conventional to general flashlight construction.

Extension housing 16 extends rearwardly from the grip 20 as shown in FIG. 1. Extension 16 has a generally tubular housing 110 which defines a threaded recess 112 at its inner end which is detachably securable to threaded projection 22 on the grip. A recess 115 extends axially from the bottom of threaded section 112 and in the assembled position as shown in FIG. 3, aligns with recess 30 to form a compartment which would be suitable for receipt of personal items such as keys, money and the like. Access to the compartment is easily accommodated by detaching the housing from the grip at the engaging threads.

The outer end of the extension 16 may contain various emergency components preferably a device for emitting some type of audible or visual alarm. As shown in FIG. 3, a high intensity light is incorporated which may be used for both purposes of illumination and to momentarily deter an attacker. The high intensity light may also provide a signal to indicate help is required. Accordingly, the outer end of the housing 16 defines an axially extending compartment 120 which receives a battery 122 which may be conventional "C" or "D" cell and may be of the rechargeable type. A spring conductor 125 urges the battery rightward as shown in FIG. 3 into contact with high intensity lamps 130 through intermediate flasher 135. A cap 140 retains the assembly in place and is in threaded engagement at threads 145 with the outer end of the extension. Switch 150 is slidable in a manner conventional and construction of flashlights will complete or break the conductive path along conductor 125 to energize or de-energize the high intensity lamps 130.

One or more clips 160 may be detachably secured to the device. The clips 160 each have a first pair of opposed spring arms 162 which are positioned to frictionally engage the exterior of extension members 14 and 16. A second pair of depending spring arms 164 are sized so as to be engageable with conventional objects such as a bicycle tubular frame member so that the device of the present invention can be conveniently carried with the individual when engaged in an activity such as bicycling.

While the preferred embodiment of the devices described above is provided with a flashlight and a high intensity light at the oppositely extending extensions, various other emergency devices such as devices for providing an audible and/or visual alarm can be incorporated into the device. As shown in FIG. 4, the high intensity light has been replaced with an audio alarm device 165 which is electrically connected to battery 122 and retained in place by cap 140. A horn 166 will emit a loud emergency signal upon actuation of switch 150.

In FIG. 5, still another variation of the invention is shown in which a transmitter 170 is electrically connected to the battery 122. The end of the housing section 16 is closed by cap 140 which is in threaded engagement with the housing and retains the transmitter 170 in place. Transmitter 170 includes a built-in antenna 172. Preferably, transmitter 170 is of the type known as an emergency locator transponder (ELT) which broadcasts on a pre-set emergency frequency such as 121.5 Mhz. The ELT can be assembled in the device in the event the user intends to hike to a remote location. In the event of an emergency, the ELT can be actuated and the signal picked up by search vehicles or planes.

Figure 7:
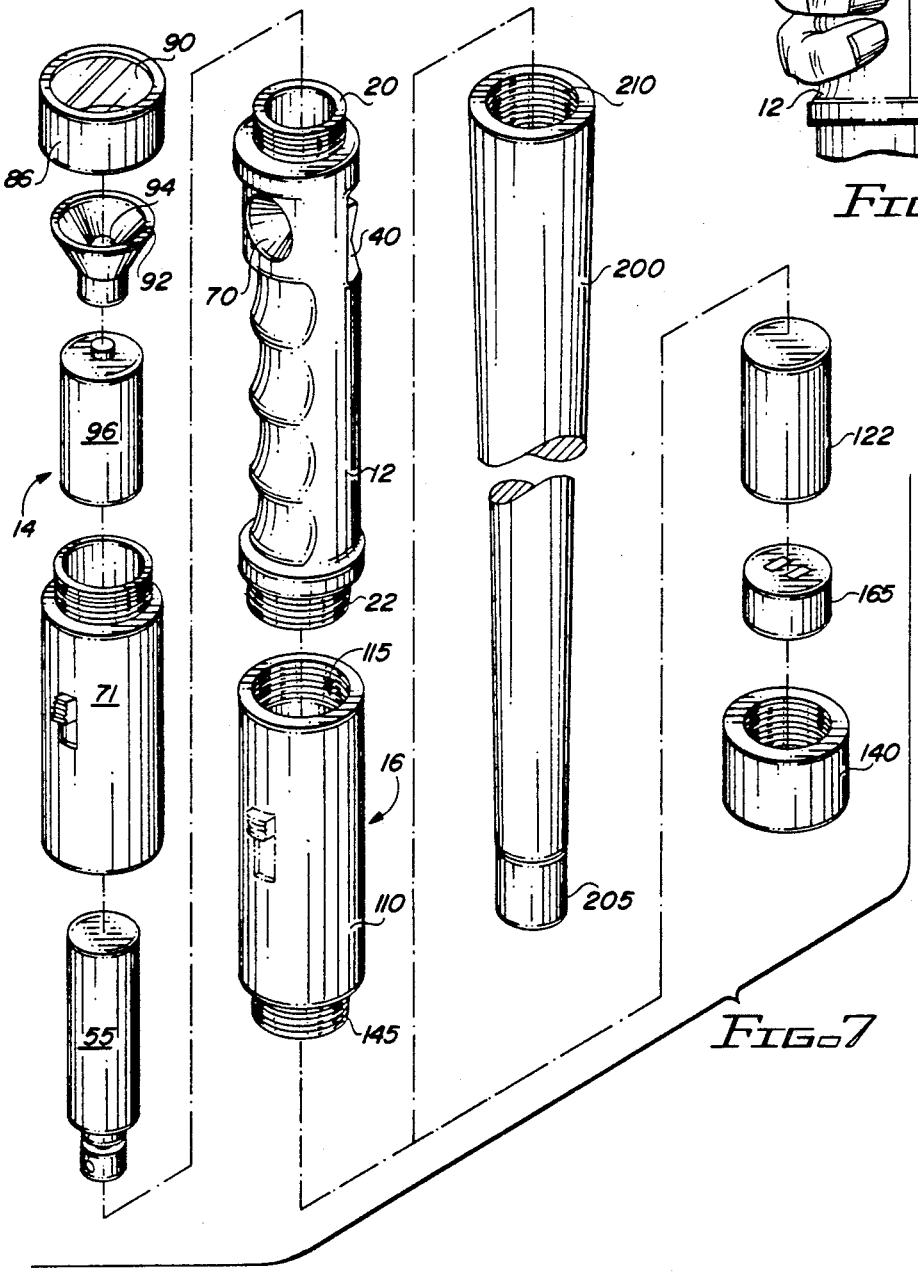
FIG. 7 is an exploded perspective view of the device of the present invention illustrating several alternative attachments.

FIG. 7 is an exploded perspective view of the device showing various of the components that may be assembled into the device. As indicated in FIG. 7, the upper extension of the device again includes the grip 12, housing extension 14 which is assembled to contain a flashlight at its outer end. The extension 14 also contains the aerosol defense spray canister 55 in a position in which the aerosol valve can be depressed causing a disabling spray to be emitted at the nozzle 70. The opposite end of the grip may be fitted with housing section 16 which defines a compartment 15 for personal items. The opposite end of the housing may be selectively equipped with a battery 122 operatively connected to a high intensity light, audible alarm device or ELT 165 as shown. As an alternative, the cap 140 may be removed and walking stick attachment 200 as shown in FIG. 7 may be detachably secured to the threaded end of housing section 16. The walking stick attachment 200 is an elongate member of suitable material such as a high impact plastic having a tip 205 at its distal end. The opposite end of the walking stick is internally threaded at 210 which threads may be engaged at threads 145 at the distal end of extension 16. Typically the walking stick would be a length ranging from approximately 25" to 35" so that when the center grip is held by the user, the walking stick will serve as a convenient aid to a hiker. The emergency transmitter 165 as shown in FIG. 7 can be retained when the walking stick is attached and is fully operable. Similarly, the flashlight contained in the opposite housing 14 would be fully operable and the defense spray would be available to the user.

The device of the present invention may be used by hikers, joggers or may be maintained close at hand for ready use on a car seat or attached to a bicycle. As indicated, the device would be fabricated from a suitable high impact plastic and could be provided in a high visibility color or, if used by law enforcement officials as a baton, may be provided in a suitable color such as black matte or wood finish. The user is provided great versatility in that the extension housings can be selectively provided with the device selected by the user and compatible with the activity. For example, for normal jogging, a flashlight would normally be contained in extension housing 14 and an audio alarm as shown in FIG. 4 or a visual alarm as shown in FIG. 3 would be assembled into extension housing 16. On the other hand, if the individual plans to hike to a remote area, housing 16 would be equipped with emergency locator transmitter 165 and in addition, the user may prefer to also secure the walking stick attachment 200. In use if the individual encounters an emergency such as a medical emergency and needs assistance, the user would activate the audio or visual alarm as appropriate. In addition, if the individual is in a remote area, the user would activate the FLT by switch 150.

As indicated above, the device is a multi-purpose device and also may serve as a defense device in the event the user is threatened with an assault. In such a case, the device would be grasped at the grip 12 and normally held in a vertical position in front of the user. This use position presents the device as a baton with the extensions 12 and 14 available to fend-off an attacker or deflect a weapon. Further, the finger recesses 34 will be engaged as shown in FIG. 6 to normally position the device with the nozzle 70 facing away from the user and towards the attacker. The automatic reflex of grasping the device and positioning it in a defensive position will position the nozzle so that discharge from the aerosol defense spray will be direted towards the attacker. The movement of the slide 40 will cause the valve on the aerosol defense spray to be actuated emitting a disabling spray such as CN, CS or OC gas which devices are readily available on the market and sold under such names as MAce or BodyGard. The baton device can also be used as a night stick to further defend against an attacker and deliver blows to the head and body of the attacker.

FIGS. 8A, 8B, 9A and 9B illustrate the device 10 provided with a safety lock. The actuator slide switch is designated by the numeral 250 and is as has been described above. The switch 250 may be manually moved forwardly against force exerted by spring 252 to bring a portion of the switch into engagement with cap 255 of the aerosol spray. Further movement will open the valve 256 releasing aerosol spray through the nozzle 260 in the device.

In order to prevent the inadvertent actuation of the aerosol spray, the device of the present invention may be provided with a safety lock. Accordingly, a transverse bore 270 is provided in the grip adjacent the switch 250. The bore receives a generally cylindrical bolt 272. The outer end of the bolt 272 is provided with a knob 275 which is accessible in recess 276 above the grip. The bolt 272 is spring biased outwardly by spring 280. The outer surface of the bolt defines an axially extending groove 284 which intersects a peripherally extending groove 285. Locking pin 288 depends into the bore and in the unlocked position shown in FIGS. 8B and 9B is received in the axial groove 284.

A recess 290 is provided in the bolt axially spaced from the circumferential groove and in the unlocked position longitudinally aligns with projection 298 on the slide switch. A land portion 295 is defined by the outer surface of the bore adjacent the groove. In the locked position shown in FIGS. 8A and 9A, projection 298 will engage the land 295 if the slide 250 is attempted to be moved forward preventing further movement of the switch and preventing actuation of the spray valve 256.

Figure 8B:
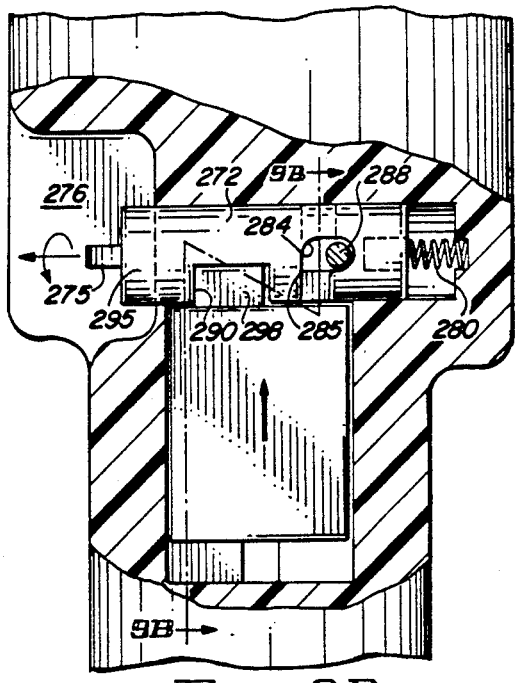
FIG. 8B is a view similar to FIG. 8A showing the safety lock in an unlocked position.
Figure 9A:
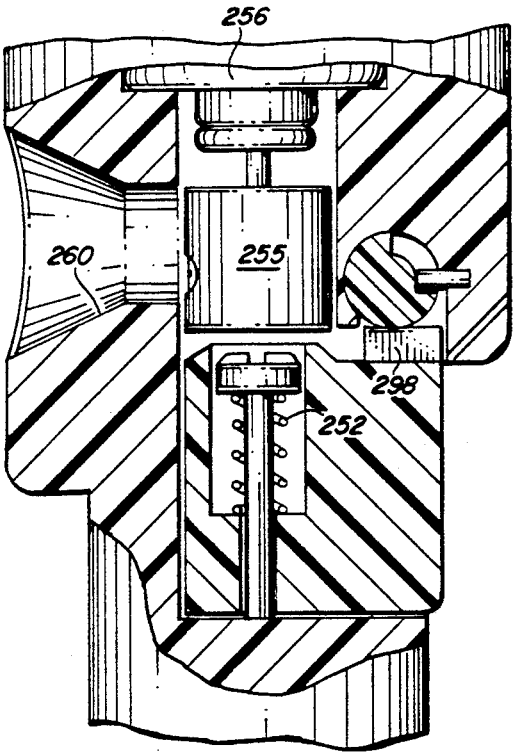
FIG. 9A is a sectional view taken along lines 9A—9A of FIG. 8A.
Figure 9B:
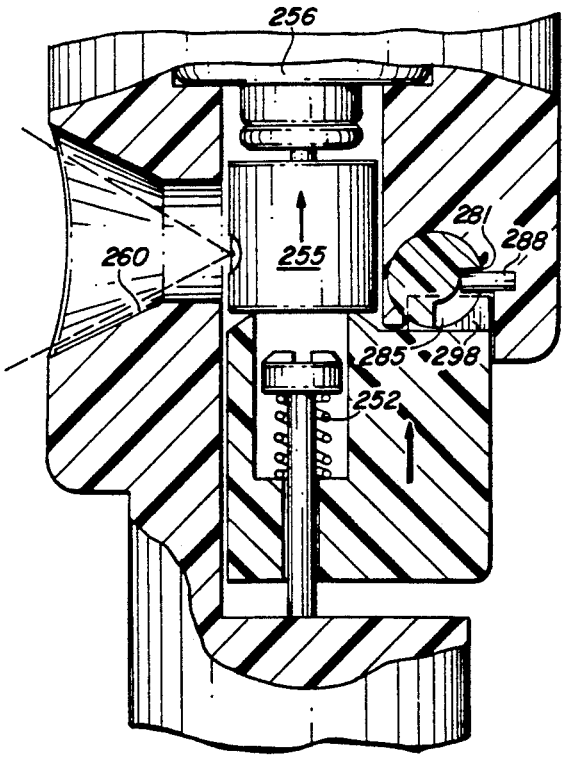
FIG. 9B is a sectional view taken along lines 9B—9B of FIG. 8B showing the lock in a closed or locked position.

In the event the user wishes to actuate the device, knob 275 is grasped and the bolt is rotated until the locking pin aligns with the axial groove 284 at which point the knob 275 is vertical as viewed in FIG. 9B. This operation will allow the bolt to be moved by spring 280 to the position shown in FIG. 8B and permit the slide switch to be moved forwardly to actuate the aerosol spray valve.

Figure 8A:
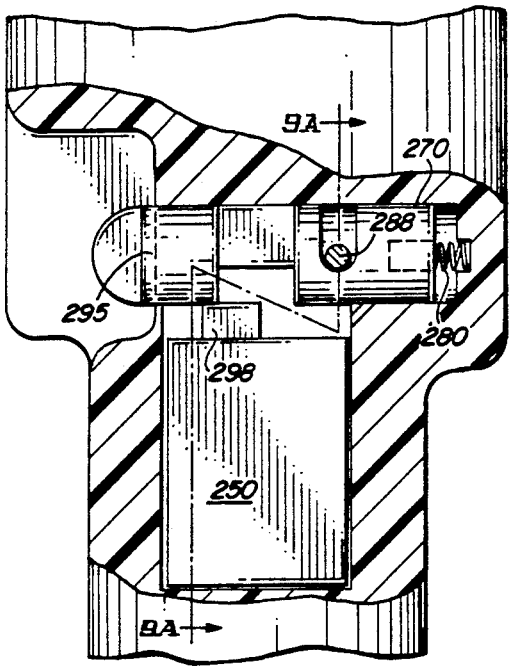
FIG. 8A is a partial top view of the actuator broken away to illustrate a safety lock in a locked position.

Pushing the bolt inwardly and thereafter rotating the knob to a position in which the locking pin is received in peripheral groove 285 will cause the bolt or spool to be locked in a position with the spool interfering with movement of the slide switch as seen in FIG. 8A. The locking and unlocking operations can easily and quickly be accomplished and simple rotation and release of the bolt will allow the device to be automatically placed in a ready state for actuation. During normal activities the device would in most cases be maintained in the locked position shown in FIGS. 8A and 9A.

Thus, it will be seen from the foregoing that the device of the present invention provides a highly versatile and adaptable baton for persons engaged in recreational pursuits such as running, jogging and hiking which may also be conveniently maintained close at hand in the home or in an automobile. The device has a grip centrally located so that it is balanced making it easy to carry when walking or running. The opposite sections extending from the grip provide an elongate night stick configuration that can be used defensively to ward off an attacker or defend against a weapon. When grasped, the device can be easily tactilely determined with the proper orientation due to the finger recesses. This orientation will orient the spray nozzle away from the user and toward any attacker.

It will be obvious to those skilled in the art to make various changes, alterations and modifications to the personal accessory and defense baton described herein. To the extent such changes, alterations and modifications do not depart from the spirit and scope of the appended claims, they are intended to be encompassed herein.

I claim:

1. A non-lethal self-defense baton comprising:

(a) a handle having a defined grip, a discharge nozzle and an actuator movable to an on-position which when manually grasped will normally orient the discharge nozzle away for the user; and (b) first and second elongate housing members oppositely extending from said grip, said first housing member defining first compartment for removably receiving a defense spray container having a valve therein positioned to opened when said actuator is moved to an on-position causing spray to be discharged at said discharge nozzle.

2. The baton of claim 1 wherein said second housing member defines a compartment and said first and second members are detachable from said handle.

3. The baton of claim 1 wherein said one of said first and second housings includes a power source, a light source at the end of the housing and a light switch.

4. The baton of claim 1 wherein one of said first and second housings includes a power source, an emergency signal device and an emergency switch.

5. The baton of claim 4 wherein said emergency signal device is a high intensity light.

6. The baton of claim 4 wherein said emergency signal device is an ELT.

7. The baton of claim 1 wherein said actuator is provided with a manually releasable safety lock.

8. The baton of claim 1 wherein said device is generally cylindrical.

9. The baton of claim 1 wherein said housings are in threaded engagement with said grip.

10. The baton of claim 9 including a walking stick which is threadably engageable with the grip to replace one of said housings.

11. The baton of claim 1 including a tether strap.

12. The baton of claim 1 wherein said baton is molded from a high impact plastic.

13. The baton of claim 12 wherein said baton is a high visibility color.

14. The baton of claim 1 including clips associated with the baton to detachably secure the device in a storage position to an object.

15. The baton of claim 1 having a generally symmetrical and cylindrical configuration.

16. The baton of claim 7 wherein said safety lock comprises a spring biased spool having a first locking and a second locked position in which second position the spool interferes with the operation of the actuator.

17. The baton of claim 16 wherein said spool is normally biased to said second locked position.

* * * * *